US008143992B2

(12) United States Patent
Sato et al.

(10) Patent No.: US 8,143,992 B2
(45) Date of Patent: Mar. 27, 2012

(54) MULTILAYER CHIP VARISTOR

(75) Inventors: Hiroyuki Sato, Tokyo (JP); Goro Takeuchi, Tokyo (JP); Osamu Taguchi, Tokyo (JP); Ryuichi Tanaka, Tokyo (JP)

(73) Assignee: TDK Corporation, Tokyo (JP)

( * ) Notice: Subject to any disclaimer, the term of this patent is extended or adjusted under 35 U.S.C. 154(b) by 351 days.

(21) Appl. No.: 12/535,307

(22) Filed: Aug. 4, 2009

(65) Prior Publication Data

US 2010/0052841 A1 Mar. 4, 2010

(30) Foreign Application Priority Data

Aug. 29, 2008 (JP) ..... 2008-221764

(51) Int. Cl.
*H01C 7/10* (2006.01)

(52) U.S. Cl. ..... 338/20; 338/21; 338/328

(58) Field of Classification Search ..... 338/20–21, 338/312, 328; 361/119, 127
See application file for complete search history.

(56) References Cited

U.S. PATENT DOCUMENTS 6,020,808 A * 2/2000 Hogge ..... 338/22 R
6,163,246 A * 12/2000 Ueda et al. ..... 338/331
6,165,866 A * 12/2000 Kobayashi ..... 438/396
7,283,032 B2 * 10/2007 Inoue et al. ..... 338/21

FOREIGN PATENT DOCUMENTS

JP A-2006-269876 10/2006

* cited by examiner

*Primary Examiner* — Kyung Lee
(74) *Attorney, Agent, or Firm* — Oliff & Berridge, PLC

(57) ABSTRACT

A multilayer chip varistor is provided as one capable of suppressing production of cracks and thereby preventing a connection failure between an internal electrode and a through-hole conductor. An internal electrode 21 is so configured as to be curved toward a direction of penetration of a through hole 10 in a connection portion 28 thereof to a through-hole conductor 27. By this configuration, a region T sandwiched between a curved surface 28*a* of the connection portion 28 and the through-hole conductor 27 is formed in a varistor layer 9 near the connection portion 28. In this region T, a metal concentration thereof becomes higher because of diffusion of metal of the internal electrode 21 and the through-hole conductor 27 into the varistor layer 9, and therefore, after completion of firing, the region T has an intermediate contraction percentage between that of the internal electrode 21 and through-hole conductor 27 and that of the other region of the varistor layer 9. This permits the region T to relax stress near the connection portion 28 where the internal electrode 21, through-hole conductor 27, and varistor layer 9 are congested so as to readily produce cracks.

3 Claims, 10 Drawing Sheets

MULTILAYER CHIP VARISTOR

BACKGROUND OF THE INVENTION

1. Field of the Invention

The present invention relates to a multilayer chip varistor.

2. Related Background Art

There is a known multilayer chip varistor having a varistor layer provided through firing to be integrated on a ceramic insulating substrate, a plurality of internal electrodes provided as opposed to each other with a part of the varistor layer in between, external electrodes provided on the exterior surface of the varistor layer, and through-hole conductors electrically connecting the external electrodes and the plurality of internal electrodes (e.g., cf. Japanese Patent Application Laid-open No. 2006-269876).

SUMMARY OF THE INVENTION

For producing the above-described multilayer chip varistor, through holes are formed in ceramic green sheets containing a ceramic powder whose major component is ZnO, and a conductor paste containing a metal (e.g., Ag or the like) as a major component is used to form conductor patterns for forming the internal electrodes, on the ceramic green sheets after the formation of the through holes. In the production process of the multilayer chip varistor, the through holes are filled with the conductor paste, and the ceramic green sheets are stacked in order and subjected to firing, whereby the ceramic green sheets become integrated. In this case, the varistor layer is made of the ceramic as a major component, whereas the internal electrodes and through-hole conductors are made of the metal. Therefore, a contraction percentage of the varistor layer in the firing is larger than that of the internal electrodes and through-hole conductors in the firing. Furthermore, the internal electrodes are formed so as to spread in a planar shape in the varistor layer; therefore, the internal electrodes contract in in-plane directions in the firing, whereas the through-hole conductors contract in directions of penetration of the through holes, i.e., in directions perpendicular to the contraction directions of the internal electrodes.

In the foregoing multilayer chip varistor, therefore, the internal electrodes and the through-hole conductors with the different contraction directions are connected near connection portions between the internal electrodes and the through-hole conductors. Furthermore, the internal electrodes and the through-hole conductors are so configured as to be surrounded by the varistor layer made of the component with the different contraction percentage from that of the internal electrodes and through-hole conductors. Therefore, the aforementioned multilayer chip varistor had the configuration wherein stress was readily generated in the firing, near the connection portions between the internal electrodes and the through-hole conductors. For this reason, the foregoing multilayer chip varistor may suffer cracks originating in the connection portions and the cracks could cause a connection failure between the internal electrodes and the through-hole conductors.

An object of the present invention is to provide a multilayer chip varistor capable of suppressing the production of cracks and thereby preventing the connection failure between the internal electrodes and the through-hole conductors.

A multilayer chip varistor according to the present invention is a multilayer chip varistor comprising: a varistor layer to exhibit a nonlinear voltage-current characteristic; a plurality of internal electrodes arranged as opposed to each other with the varistor layer in between; and a through-hole conductor formed in a through hole penetrating the varistor layer and the plurality of internal electrodes, the through-hole conductor electrically connecting the plurality of internal electrodes, wherein at least one of the plurality of internal electrodes is curved toward a direction of penetration of the through hole in a connection portion thereof to the through-hole conductor.

In the multilayer chip varistor according to the present invention, at least one of the plurality of internal electrodes is so configured as to be curved toward the direction of penetration of the through hole in the connection portion to the through-hole conductor. When the connection portion is curved toward the direction of penetration of the through hole, a region sandwiched between a curved surface of the connection portion and the through-hole conductor is formed in the varistor layer near the connection portion, on a one-side surface of the internal electrode. This region is sandwiched between the curved surface of the internal electrode and the through-hole conductor. Therefore, metal diffuses into the varistor layer to increase a metal concentration in this region, whereby the contraction percentage of this region in the firing becomes larger than that of the internal electrodes and the through-hole conductor and smaller than that of the varistor layer. Because of this effect, the region with the high metal concentration in the varistor layer acts to relax stress generated in the firing, which suppresses production of cracks originating in the connection portion. Furthermore, the suppression of production of cracks leads eventually to preventing a connection failure between the internal electrode and the through-hole conductor.

The multilayer chip varistor according to the present invention is preferably so configured that in the internal electrode curved in the connection portion, a thickness in a contact portion with the through-hole conductor is larger than a thickness in a portion other than the connection portion. This configuration increases the area of the contact portion of the internal electrode to the through-hole conductor and thereby further prevents the connection failure between the internal electrode and the through-hole conductor.

Another multilayer chip varistor according to the present invention is a multilayer chip varistor comprising: a varistor layer to exhibit a nonlinear voltage-current characteristic; a plurality of internal electrodes arranged as opposed to each other with the varistor layer in between; and a through-hole conductor formed in a through hole penetrating the varistor layer and the plurality of internal electrodes, the through-hole conductor electrically connecting the plurality of internal electrodes, wherein at least one of the plurality of internal electrodes is so configured in a connection portion thereof to the through-hole conductor that the varistor layer is sandwiched between the internal electrode and the through-hole conductor in a direction perpendicular to a direction of penetration of the through hole.

In the multilayer chip varistor according to the present invention, at least one of the plurality of internal electrodes is so configured in the connection portion to the through-hole conductor that the varistor layer is sandwiched between the internal electrode and the through-hole conductor in the direction perpendicular to the direction of penetration of the through hole. In the region of the varistor layer sandwiched between the connection portion of the internal electrode and the through-hole conductor, metal diffuses into the varistor layer to increase a metal concentration. Therefore, the contraction percentage of this region in the firing becomes larger than that of the internal electrodes and the through-hole conductor and smaller than that of the varistor layer. Because of this effect, the region with the high metal concentration in the varistor layer acts to relax stress generated in the firing, which suppresses production of cracks originating in the connection portion. Furthermore, the suppression of production of cracks leads eventually to preventing a connection failure between the internal electrode and the through-hole conductor.

The multilayer chip varistor according to the present invention is preferably so configured that at least one of the internal electrodes is depressed in the direction of penetration of the through hole so as to be tapered in the connection portion, whereby the varistor layer is sandwiched between the internal electrode and the through-hole conductor in the direction perpendicular to the direction of penetration of the through hole. In the simple configuration wherein the internal electrode is depressed so as to be tapered in the connection portion, the varistor layer is sandwiched between the internal electrode and the through-hole conductor in the direction perpendicular to the direction of penetration of the through hole.

DESCRIPTION OF THE PREFERRED EMBODIMENTS

The preferred embodiments of the present invention will be described below in detail with reference to the accompanying drawings. In the description, the same elements or elements with the same functionality will be denoted by the same reference symbols, without redundant description.

Figure 1:
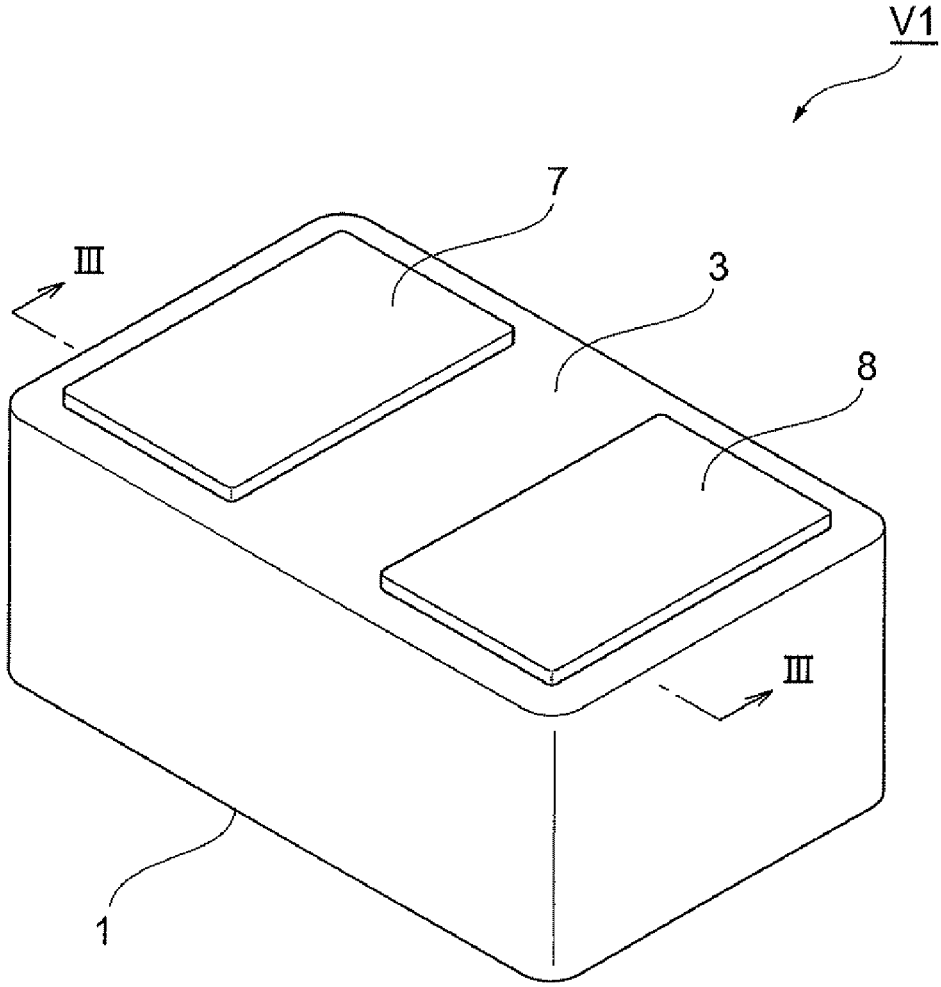
FIG. 1 is a perspective view showing a multilayer chip varistor according to an embodiment of the present invention.
Figure 2:
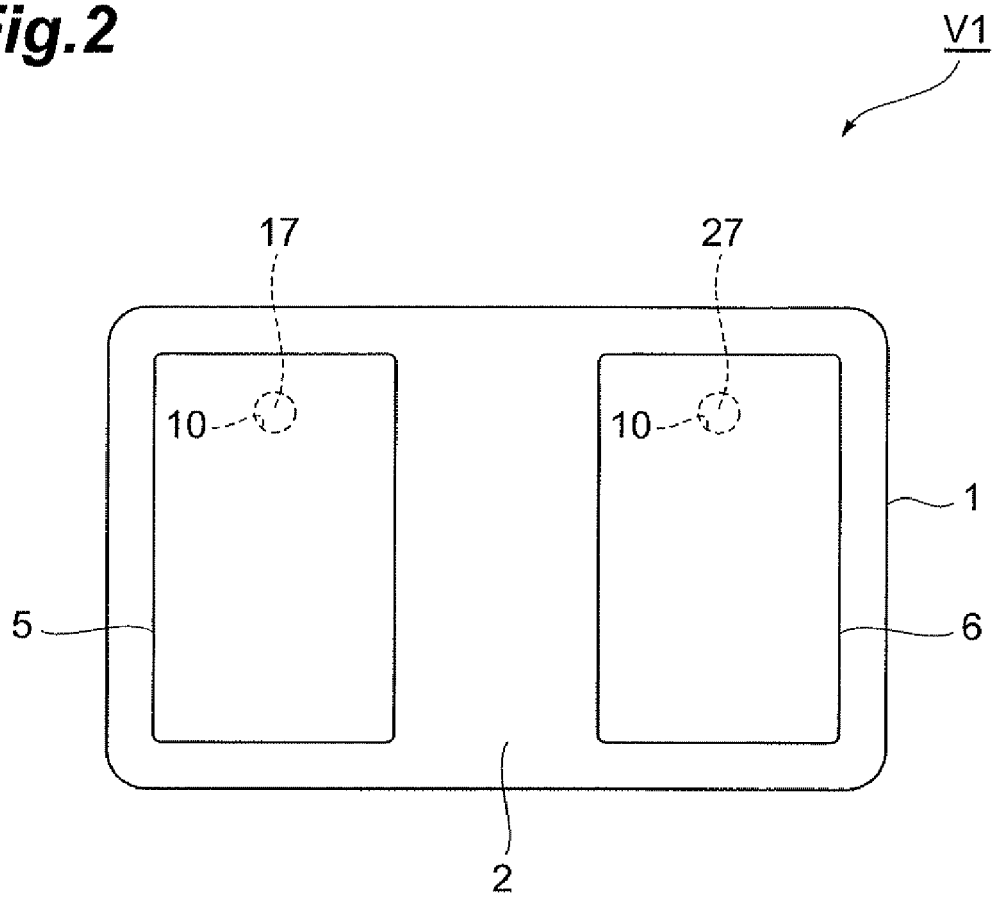
FIG. 2 is a bottom view showing the multilayer chip varistor according to the embodiment.
Figure 3:
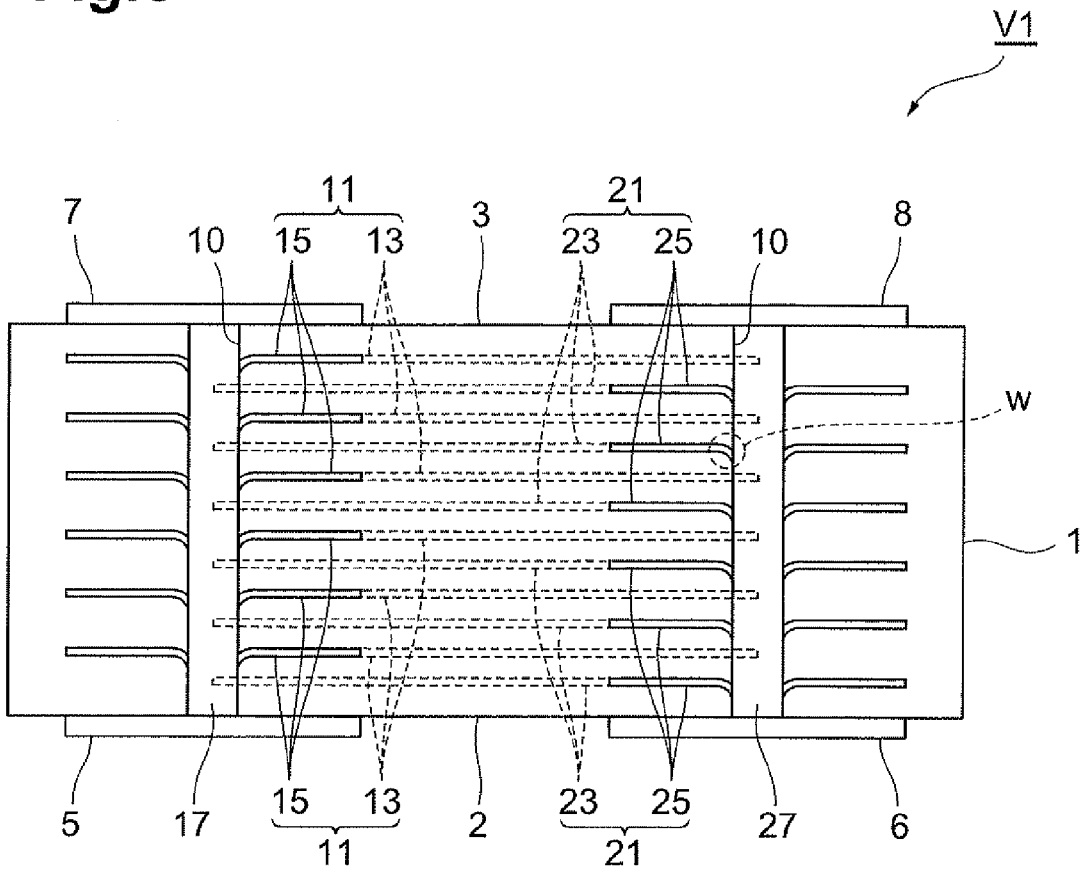
FIG. 3 is a sectional view along line III-III shown in FIG. 1, of the multilayer chip varistor according to the embodiment.
Figure 4:
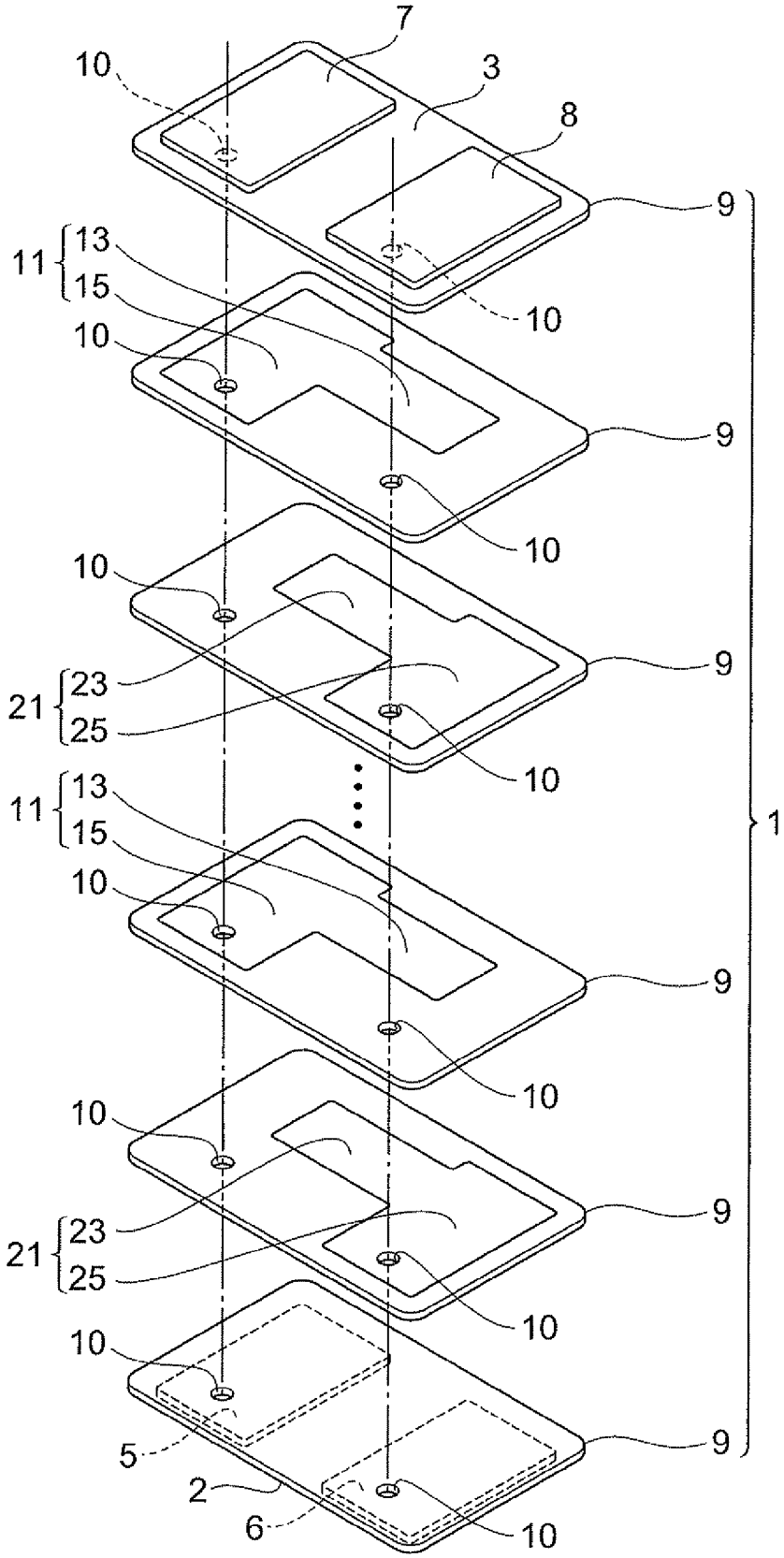
FIG. 4 is a development view in which a varistor element body is developed for illustrating each of varistor layers.

A configuration of a multilayer chip varistor V1 according to the present embodiment will be described with reference to FIGS. 1 to 4. FIG. 1 is a perspective view showing the multilayer chip varistor V1 of the present embodiment. FIG. 2 is a bottom view showing the multilayer chip varistor V1 of the present embodiment. FIG. 3 is a sectional view along line III-III shown in FIG. 1, of the multilayer chip varistor V1 of the present embodiment. FIG. 4 is a development view where a varistor element body 1 is developed for illustrating each of varistor layers 9. FIG. 3 is depicted without hatching, in order to clearly show configurations of respective components. FIG. 4 is depicted without illustration of through-hole conductors 17, 27 and with illustration of through holes 10 formed in varistor layers 9.

As shown in FIGS. 1 and 2, the multilayer chip varistor V1 is constructed with a varistor element body 1 of a nearly rectangular parallelepiped shape in which a plurality of plate-like varistor layers are laminated together to be integrated, a plurality (a pair in the present embodiment) of external electrodes 5, 6, and a plurality (a pair in the present embodiment) of external electrodes 7, 8. The pair of external electrodes 5, 6 are formed each on one principal face 2 of the varistor element body 1. The pair of external electrodes 7, 8 are formed each on the other principal face 3 of the varistor element body 1. The dimensions of the varistor element body 1 are set, for example, to be approximately 1.0-2.0 mm long, approximately 0.8-1.5 mm wide, and approximately 0.2-0.8 mm thick. One external electrode 5 functions as an input terminal electrode of the multilayer chip varistor V1 and the other external electrode 6 as an output terminal electrode of the multilayer chip varistor V1. The external electrodes 7, 8 function as pad electrodes electrically connected to an electronic component such as a semiconductor light emitting device.

The external electrode 5 and the external electrode 6 are arranged with a predetermined space between them and on both longitudinal end sides of the principal face 2, on the rectangular principal face 2 of the varistor element body 1. The external electrodes 5, 6 are of a rectangular shape extending along the width direction of the principal face 2. The dimensions of the external electrodes 5, 6 are set, for example, as follows: a length of each long side approximately 600 μm; a length of each short side approximately 300 μm; a thickness approximately 2 μm.

The external electrode 7 and the external electrode 8 are arranged with a predetermined space between them and on both longitudinal end sides of the principal face 3, on the rectangular principal face 3 of the varistor element body 1. The external electrodes 7, 8 are of a rectangular shape extending along the width direction of the principal face 3. The dimensions of the external electrodes 7, 8 are set, for example, as follows: a length of each long side approximately 600 μm; a length of each short side approximately 300 μm; a thickness approximately 2 μm.

The external electrodes 5, 6 and the external electrodes 7, 8 are formed by transferring an electrode paste containing Ag or the like as a major component, onto the exterior surface of the varistor element body 1, firing it at a predetermined temperature (e.g., about 700° C.), and electroplating the fired electrode paste. The electroplating can be carried out using Ni/Au or the like.

The varistor element body 1, as shown in FIG. 4, is constructed as a laminate in which a plurality of varistor layers 9 of a rectangular plate shape to exhibit a nonlinear voltage-current characteristic (hereinafter referred to as "varistor characteristic"), and a plurality of internal electrodes 11 and internal electrodes 21 are laminated together. The internal electrodes 11 and the internal electrodes 21 are arranged in respective layers along a lamination direction of the varistor layers 9 (which will be referred to hereinafter simply as "lamination direction") in the varistor element body 1. The internal electrodes 11 and the internal electrodes 21 are arranged as opposed to each other with at least one varistor layer 9 in between. As shown in FIGS. 3 and 4, the pair of principal faces 2, 3 of the varistor element body 1 are opposed to each other and are perpendicular to the lamination direction of the varistor layers 9, i.e., perpendicular to the direction in which the internal electrodes 11 and 21 are opposed to each other. In the practical multilayer chip varistor V1, the plurality of varistor layers 9 are so integrated that no boundary can be visually recognized between them.

The varistor layers 9 are made of a substance containing ZnO (zinc oxide) as a major component and also containing as minor components, simple metals such as rare-earth metals, Co, IIIb elements (B, Al, Ga, In), Si, Cr, Mo, alkali metals (K, Rb, Cs), and alkali earth metals (Mg, Ca, Sr, Ba), and/or oxides thereof. In the present embodiment, the varistor layers 9 may contain Pr, Co, Cr, Ca, Si, K, Al, and so on as minor components. Co and Pr serve as materials to make the varistor layers 9 exhibit the varistor characteristic. There are no particular restrictions on a content of ZnO in the varistor layers 9, but the content is preferably in the range of 69.0 to 99.8% by mass, where the total content of materials forming the varistor layers 9 is 100% by mass. In the present embodiment, the content of ZnO is particularly preferably not less than 95% by mass. The thickness of each varistor layer 9 is, for example, approximately in the range of 20 to 30 μm.

Each of the internal electrodes 11, as shown in FIG. 4, includes an electrode portion 13 and an electrode portion 15. The electrode portion 13 is formed in a rectangular shape extending along the longitudinal direction of the varistor layer 9, in a nearly central region of the varistor layer 9. This electrode portion 13 is so configured as to overlap with a below-described electrode portion 23 of the internal electrode 21, when viewed from the lamination direction. The electrode portion 15 is drawn from the electrode portion 13 and functions as a lead conductor. The electrode portion 15 is formed integrally with the electrode portion 13. This electrode portion 15 is formed in such a rectangular shape as to overlap with the external electrode 5 and the external electrode 7, when viewed from the lamination direction, on one longitudinal end side of the varistor layer 9.

The electrode portions 15, as shown in FIG. 3, are physically and electrically connected to each other by a through-hole conductor 17. The through-hole conductor 17 is formed so as to extend in the lamination direction in the varistor element body 1. One end of the through-hole conductor 17 is physically and electrically connected to the external electrode 5. The other end of the through-hole conductor 17 is physically and electrically connected to the external electrode 7. This connection structure makes the electrode portions 13 of the respective internal electrodes 11 electrically connected to the external electrode 5 and to the external electrode 7 through the electrode portions 15 and the through-hole conductor 17. The electrode portion 15 of each internal electrode 11 is curved toward a direction of penetration of the through hole 10 (i.e., the lamination direction), in its connection portion to the through-hole conductor 17. The detailed description will be given below for the configuration of this connection portion.

Each of the internal electrodes 21, as shown in FIG. 4, includes an electrode portion 23 and an electrode portion 25. The electrode portion 23 is formed in a rectangular shape extending along the longitudinal direction of the varistor layer 9, in a nearly central region of the varistor layer 9. This electrode portion 23 is so configured as to overlap with the electrode portion 13 of internal electrode 11, when viewed from the lamination direction. The electrode portion 25 is drawn from the electrode portion 23 and functions as a lead conductor. The electrode portion 25 is formed integrally with the electrode portion 23. This electrode portion 25 is formed in such a rectangular shape as to overlap with the external electrode 6 and the external electrode 8, when viewed from the lamination direction, on the other longitudinal end side of the varistor layer 9.

The electrode portions 25, as shown in FIG. 3, are physically and electrically connected to each other by a through-hole conductor 27. The through-hole conductor 27 is formed so as to extend in the lamination direction in the varistor element body 1. One end of the through-hole conductor 27 is physically and electrically connected to the external electrode 6. The other end of the through-hole conductor 27 is physically and electrically connected to the external electrode 8. This connection structure makes the electrode portions 23 of the respective internal electrodes 21 electrically connected to the external electrode 6 and to the external electrode 8 through the electrode portions 25 and the through-hole conductor 27. The electrode portion 25 of each internal electrode 21 is curved toward the direction of penetration of the through hole 10 (i.e., the lamination direction), in its connection portion to the through-hole conductor 27. The detailed description will be given below for the configuration of this connection portion.

The internal electrodes 11, 21 contain an electroconductive material. There are no particular restrictions on the electroconductive material in the internal electrodes 11, 21, but it is preferably a material consisting of Ag or an Ag—Pd alloy. When the internal electrodes 11, 21 contain Ag, Ag in them can readily diffuse into ZnO in the varistor layers 9. The thickness of each internal electrode 11, 21 is, for example, approximately in the range of 1 to 5 μm and in the present embodiment the thickness is particularly preferably not less than 2 μm. This thickness range enables the internal electrodes 11, 21 to be well connected to the through-hole conductors 17, 27 and can keep the thickness of the internal electrodes 11, 21 enough even with the curvature of the connection portions between the internal electrodes 11, 21 and the through-hole conductors 17, 27 so as to prevent breakage of the internal electrodes (the details of which will be described later). The internal electrodes 11, 21 are constructed as sintered bodies of an electroconductive paste containing the aforementioned electroconductive material.

The through-hole conductors 17, 27 contain an electroconductive material. The electroconductive material in the through-hole conductors 17, 27 is preferably at least one metal selected from the group consisting of Pd, Ag, Cu, W, Mo, Sn, and Ni, or an alloy containing at least one of the foregoing metals. In the present embodiment, the electroconductive material contains Ag. When the through-hole conductors 17, 27 contain Ag, Ag in them can readily diffuse into ZnO in the varistor layers 9. The diameter of the through-hole conductors 17, 27 is, for example, approximately in the range of 10 to 500 μm.

The through-hole conductors 17, 27 are made by forming the through holes 10 penetrating each of the varistor layers 9 in the lamination direction, as shown in FIG. 4, by punching or drilling, filling the through holes 10 with an electroconductive paste, and firing it simultaneously with the varistor layers 9 and internal electrodes 11, 21. The through holes 10 are formed as follows: a plurality of varistor layers 9 are laminated together to obtain a laminate and thereafter the laminate is perforated by punching or drilling.

The electrode portions 13 of the internal electrodes 11 and the electrode portions 23 of the internal electrodes 21 overlap with each other as described above. Therefore, overlap regions of the varistor layers 9 with the electrode portions 13 and the electrode portions 23 function as regions to exhibit the varistor characteristic. In the multilayer chip varistor V1 having the above-described configuration, one varistor section is constituted by the electrode portions 13, the electrode portions 23, and the overlap regions of the varistor layers 9 with the electrode portions 13 and electrode portions 23.

Figure 5:
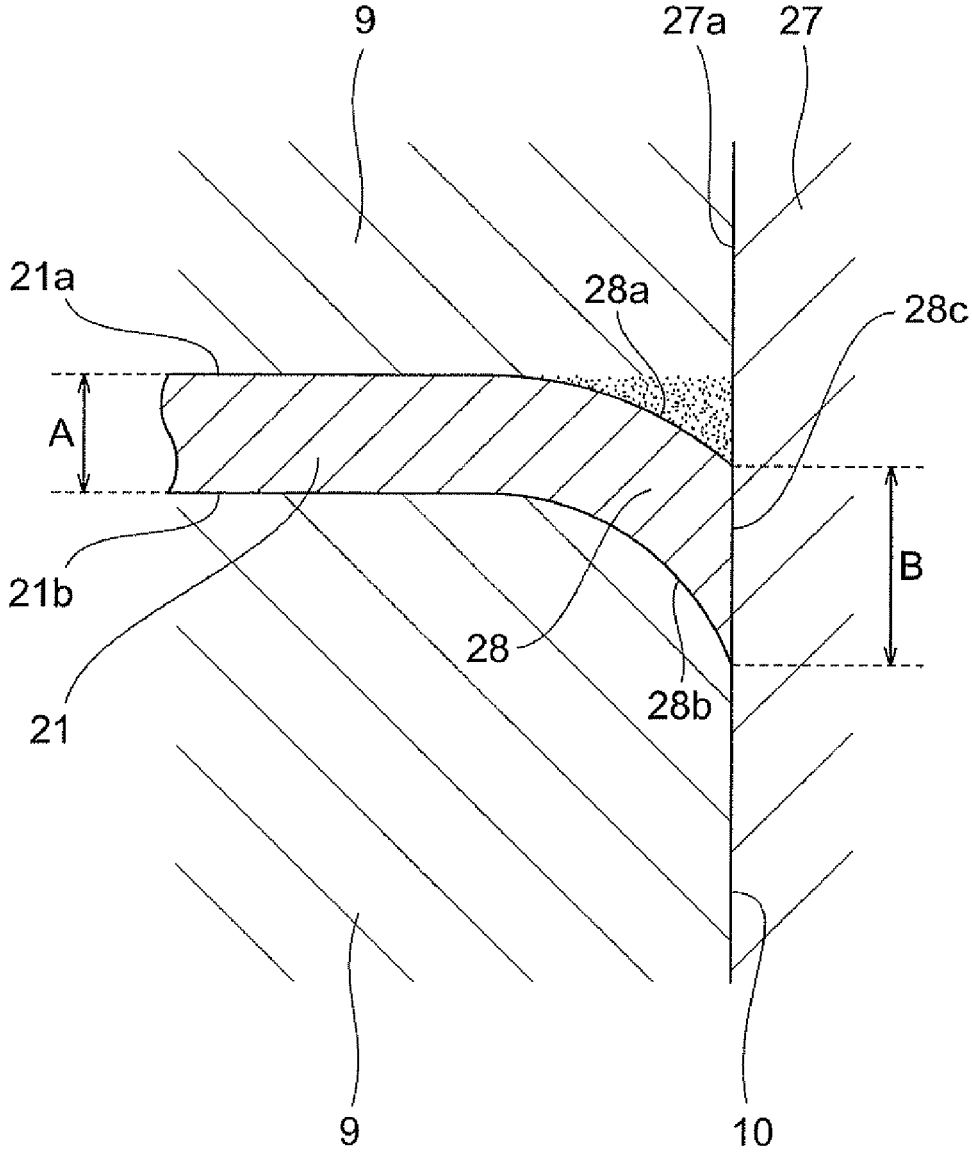
FIG. 5 is an enlarged sectional view of a region enclosed in W shown in FIG. 3.
Figure 6:
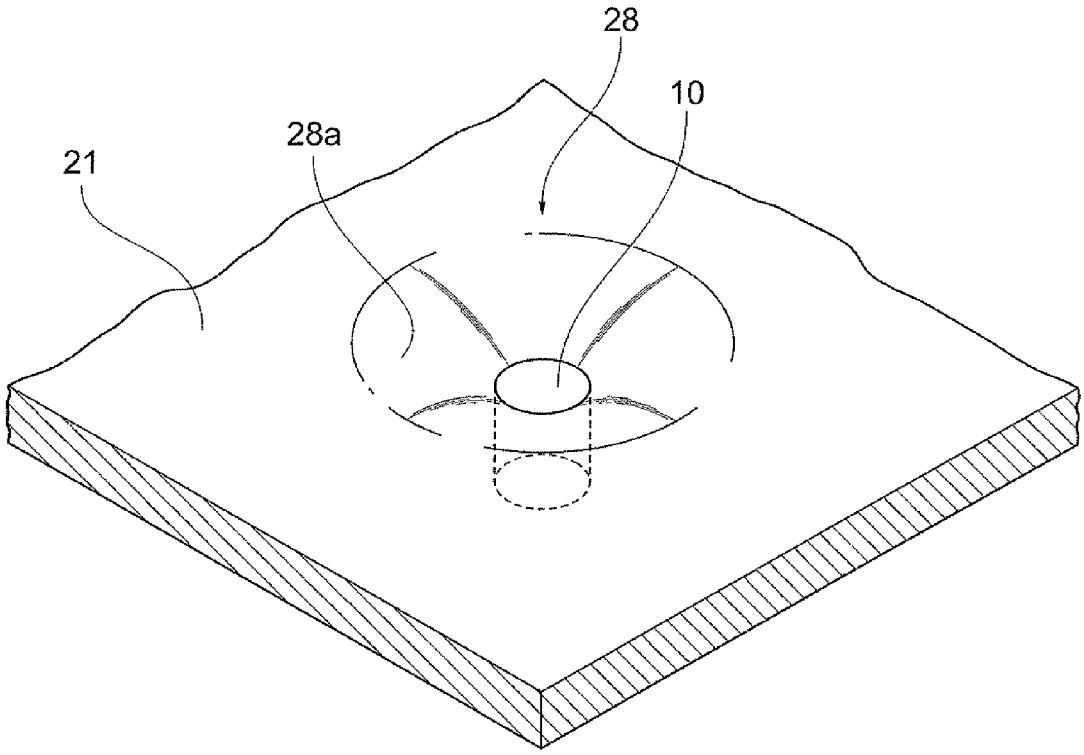
FIG. 6 is a perspective view of a region near a connection portion of an internal electrode to a through-hole conductor.

The below will detail the configuration near the connection portions of the internal electrodes with the through-hole conductors, with reference to FIGS. 5 and 6. FIG. 5 is an enlarged sectional view of a region enclosed in W shown in FIG. 3. FIG. 6 is a perspective view of a region near a connection portion of an internal electrode 21 to the through-hole conductor. In FIGS. 5 and 6, a configuration of only one internal electrode 21 is shown, but the other internal electrodes 21 also have the same configuration. The plurality of internal electrodes 11 also have the same configuration. FIG. 6 is depicted without illustration of the varistor layers 9 and through-hole conductor 27, and with illustration of an internal electrode 21 and a through hole 10 only.

As shown in FIGS. 5 and 6, the internal electrode 21 is curved toward the penetration direction of the through hole 10, in its connection portion 28 to the through-hole conductor 27. The connection portion 28 is curved in an arched cross section, specifically, in such a manner that the internal electrode 21 is pushed out in the penetration direction from the principal face 3 to the principal face 2 on the through hole 10. As the connection portion 28 is so curved, a surface 21*a* on the principal face 3 side of the internal electrode 21 and an opposite surface 21*b* thereof come to have a curved surface 28*a* and a curved surface 28*b*, respectively, formed in the connection portion 28. The curved surface 28*a* has such a shape as to be gradually indented from the surface 21*a* toward the surface 21*b*, with decreasing distance to the through hole 10. The curved surface 28*b* has such a shape as to gradually leave the surface 21*b*, with decreasing distance to the through hole 10, corresponding to the shape of the curved surface 28*a*. The curved surfaces 28*a*, 28*b* are formed throughout the entire circumference of the through hole 10, whereby the internal electrode 21 is configured as depressed in the penetration direction of the through hole 10 so as to be tapered approximately in a frustum shape of a circular cone in the connection portion 28.

As the curved connection portion 28 is so formed, a region T is defined as a region sandwiched between the internal electrode 21 and the through-hole conductor 27 in a direction perpendicular to the penetration direction of the through hole 10, in part of the varistor layer 9 near the connection portion 28 (which is a region indicated by a pear-skin pattern in FIG. 5). This region T is a region sandwiched between an outer peripheral surface 27*a* of the through-hole conductor 27 and the curved surface 28*a* in the connection portion 28 of the internal electrode 21, and is formed throughout the entire circumference of the through-hole conductor 27. Since this region T is sandwiched between the internal electrode 21 and the through-hole conductor 27 made of the metal containing Ag as a major component, it has a high metal concentration because of diffusion of the metal into the varistor layer 9 containing ZnO as a major component. The distance between the internal electrode 21 and the through-hole conductor 27 decreases toward a contact point between the outer peripheral surface 27*a* of the through-hole conductor 27 and the curved surface 28*a*. Therefore, the metal concentration in the region T also increases with decreasing distance to the contact point between the outer peripheral surface 27*a* of the through-hole conductor 27 and the curved surface 28*a*.

In the internal electrode 21, the thickness of a contact portion 28*c* with the through-hole conductor 27 is larger than the thickness of the portion other than the connection portion 28. The contact portion 28*c* of the internal electrode 21 is an inner peripheral surface of the through hole 10 in the internal electrode 21 and is a portion in surface contact throughout the entire circumference with the outer peripheral surface 27*a* of the through-hole conductor 27. In FIG. 5, the thickness of the contact portion 28*c* is indicated by B and the thickness B of the contact portion 28*c* is larger than the thickness of the internal electrode 21 indicated by A.

The connection portion 28 curved in this manner is formed as follows: on the occasion of forming the through hole 10 in the unfired varistor layer 9 by punching or drilling, the edge of the varistor layer 9 around the through hole 10 is curved toward the penetration direction; on the occasion of applying the Ag paste for formation of the internal electrode 21, onto the varistor layer 9, the Ag paste is applied along the curvature of the edge around the through hole 10; it is fired simultaneously with the varistor layers 9 and the through-hole conductors 17, 27.

Figure 7:
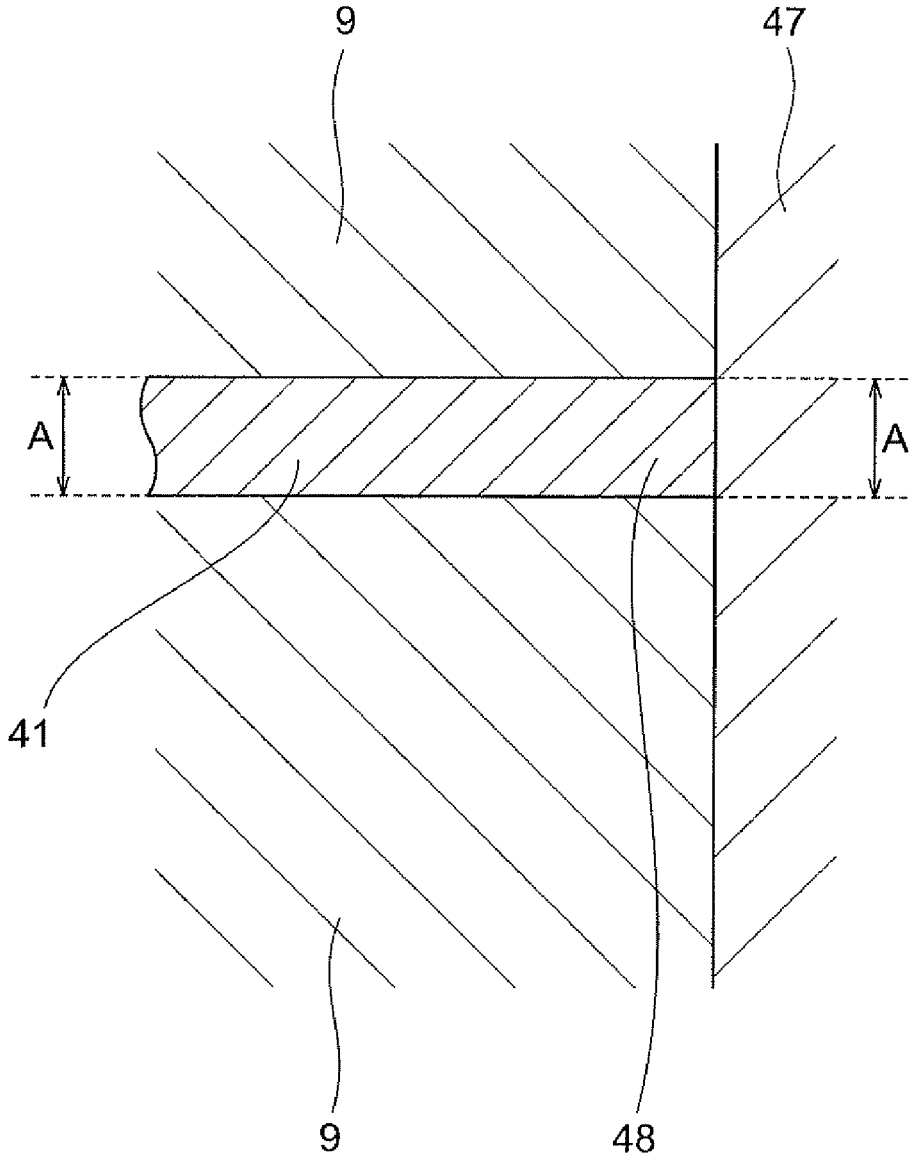
FIG. 7 is an enlarged sectional view showing a configuration of a connection portion in a conventional multilayer chip varistor, which is a drawing corresponding to FIG. 5.

The below will describe the action and effect of the multilayer chip varistor V1 of the present embodiment with reference to FIGS. 5 to 7. FIG. 7 is an enlarged sectional view showing a configuration of a connection portion in a conventional multilayer chip varistor, which is a drawing corresponding to FIG. 5.

First, the conventional multilayer chip varistor will be explained for a comparison's sake. The conventional multilayer chip varistor is constructed by laminating a plurality of varistor layers 9 with internal electrodes thereon and physically and electrically connecting the internal electrodes through through-hole conductors, as the multilayer chip varistor V1 of the present embodiment is. However, the conventional multilayer chip varistor is different from the multilayer chip varistor V1 of the present embodiment in that the connection portions of the internal electrodes to the through-hole conductors are not curved. Specifically, as shown in FIG. 7, a through-hole conductor 47 is formed in a through hole penetrating the varistor layers 9 and internal electrode 41 in the lamination direction. The internal electrode 41 is not curved and is connected perpendicularly to the through-hole conductor 47, in its connection portion 48 to the through-hole conductor 47. There is no change in the thickness of the connection portion 48 and the thickness of the connection portion 48 in the contact portion is equal to the thickness of the internal electrode 41 everywhere as indicated by A in FIG. 7.

The conventional multilayer chip varistor as described above has such a configuration that the internal electrode 41, the through-hole conductor 47, and the varistor layers 9 are congested near the connection portion 48 of the internal electrode 41 to the through-hole conductor 47. The varistor layers 9 are made of the material containing ZnO as a major component, whereas the internal electrode 41 and through-hole conductor 47 are made of the metal containing Ag as a major component. A contraction percentage of the varistor layers 9 in the firing is different from a contraction percentage of the internal electrode 41 and through-hole conductor 47 in the firing.

The internal electrode 41 and the through-hole conductor 47 start contracting at a temperature lower than the varistor layers 9, and a contraction amount thereof at a temperature at the time of completion of the firing is smaller than that of the varistor layers 9. Namely, the varistor layers 9 have the contraction percentage in the firing larger than that of the internal electrode 41 and the through-hole conductor 47.

Furthermore, in the conventional multilayer chip varistor the internal electrode 41 is formed on a top surface of one varistor layer 9 and is formed so as to spread in a planar shape in directions perpendicular to the lamination direction inside the varistor element body. Therefore, the internal electrode 41 contracts in in-plane directions perpendicular to the lamination direction in the firing. On the other hand, the through-hole conductor 47 is formed so as to extend in the penetration direction of the through hole, i.e., in a direction coincident with the lamination direction. Therefore, the through-hole conductor 47 contracts in the penetration direction (lamination direction) of the through hole in the firing. As described above, the internal electrode 41 and the through-hole conductor 47 are configured so as to contract in their respective directions perpendicular to each other, in the firing.

In the conventional multilayer chip varistor, as described above, the internal electrode 41 and the through-hole conductor 47 to contract in the different directions are connected near the connection portion 48 of the internal electrode 41 to the through-hole conductor 47 and, the internal electrode 41 and through-hole conductor 47 are surrounded by the varistor layers 9 made of the component with the different contraction percentage; therefore, it is the configuration to easily generate stress in the firing. This may produce cracks originating in the connection portion 48 and the cracks could cause a connection failure between the internal electrode 41 and the through-hole conductor 47.

In contrast to it, the multilayer chip varistor V1 of the present embodiment has the configuration wherein the internal electrode 21 is curved toward the penetration direction of the through hole 10 in the connection portion 28 to the through-hole conductor 27, as shown in FIG. 5. Furthermore, the region T sandwiched between the curved surface 28*a* of the connection portion 28 and the outer peripheral surface 27*a* of the through-hole conductor 27 is formed in the varistor layer 9 near the connection portion 28, on the surface 21*a* side of the internal electrode 21. In this region T, as described above, the metal concentration is high because of diffusion of the metal of the internal electrode 21 and the through-hole conductor 27 into the varistor layer 9, and thus the region T has a contraction characteristic different from that of the other region of the varistor layer 9.

The region T of the varistor layer 9 starts contracting at a temperature higher than the internal electrode 21 and through-hole conductor 27 and lower than the other region of the varistor layer 9. In the region T of the varistor layer 9, a contraction amount thereof at the temperature at the time of completion of the firing is larger than that of the internal electrode 21 and through-hole conductor 27 and smaller than that of the other region of the varistor layer 9. Namely, the region T of the varistor layer 9 has an intermediate contraction characteristic between the contraction characteristic of the internal electrode 21 and through-hole conductor 27 and the contraction characteristic of the other region of the varistor layer 9 in the firing.

As described above, the multilayer chip varistor V1 has the configuration wherein the region T having the intermediate contraction percentage between that of the conductor metal and that of the varistor layers 9 is arranged near the connection portions 28 where the internal electrode 21, through-hole conductor 27, and varistor layers 9 are congested to readily cause cracks. This permits the region T to act to relax the stress generated near the connection portions 28 in the firing, which suppresses production of cracks originating at the connection portion 28. Furthermore, the suppression of production of cracks leads eventually to also preventing a connection failure between the internal electrode 21 and the through-hole conductor 27.

In the multilayer chip varistor V1 of the present embodiment, the thickness of the internal electrode 21 in the contact portion 28*c* with the through-hole conductor 27 is larger than the thickness in the portion other than the connection portion 28. Therefore, the area of the contact portion 28*c* of the internal electrode 21 to the through-hole conductor 27 becomes larger, which further prevents the connection failure between the internal electrode 21 and the through-hole conductor 27.

In the multilayer chip varistor V1 of the present embodiment, the internal electrode 21 is depressed in the penetration direction of the through hole 10 so as to be tapered in the connection portion 28, whereby the varistor layer 9 is sandwiched between the internal electrode 21 and the through-hole conductor 27. This structure permits the varistor layer 9 to be sandwiched between the internal electrode 21 and the through-hole conductor 27 in the simple configuration wherein the internal electrode 21 is tapered in the connection portion 28.

The above described only the connection portion 28 of the internal electrode 21 with the through-hole conductor 27, but the same action and effect can also be achieved as to the connection portion of the internal electrode 11 with the through-hole conductor 17.

The above described the preferred embodiment of the present invention, but it should be noted that the present invention is by no means limited to the above-described embodiment and that the present invention can be modified in various ways without departing from the spirit and scope of the invention.

For example, the present embodiment showed the configuration wherein the connection portions 28 were curved toward the penetration direction from the principal face 3 to the principal face 2, but the connection portions may be curved toward the opposite direction. Namely, the connection portions 28 may be curved toward the penetration direction from the principal face 2 to the principal face 3.

The present embodiment showed the configuration wherein all the internal electrodes were curved in their connection portions with the through-hole conductors, but it is sufficient that at least one internal electrode be curved in its connection portion; for example, it is possible to adopt a configuration wherein only an internal electrode is curved at a position where cracks are particularly easily produced in the varistor element body.

The present embodiment showed the configuration wherein the region T of the varistor layer was sandwiched by curving the connection portion, but instead thereof, the varistor layer may be sandwiched by bending the internal electrode toward the penetration direction of the through hole in the connection portion. Namely, there are no restrictions on the shape of the connection portion, and any shape can be adopted as long as a part of the varistor layer can be sandwiched between the internal electrode and the through-hole conductor.

Figure 8:
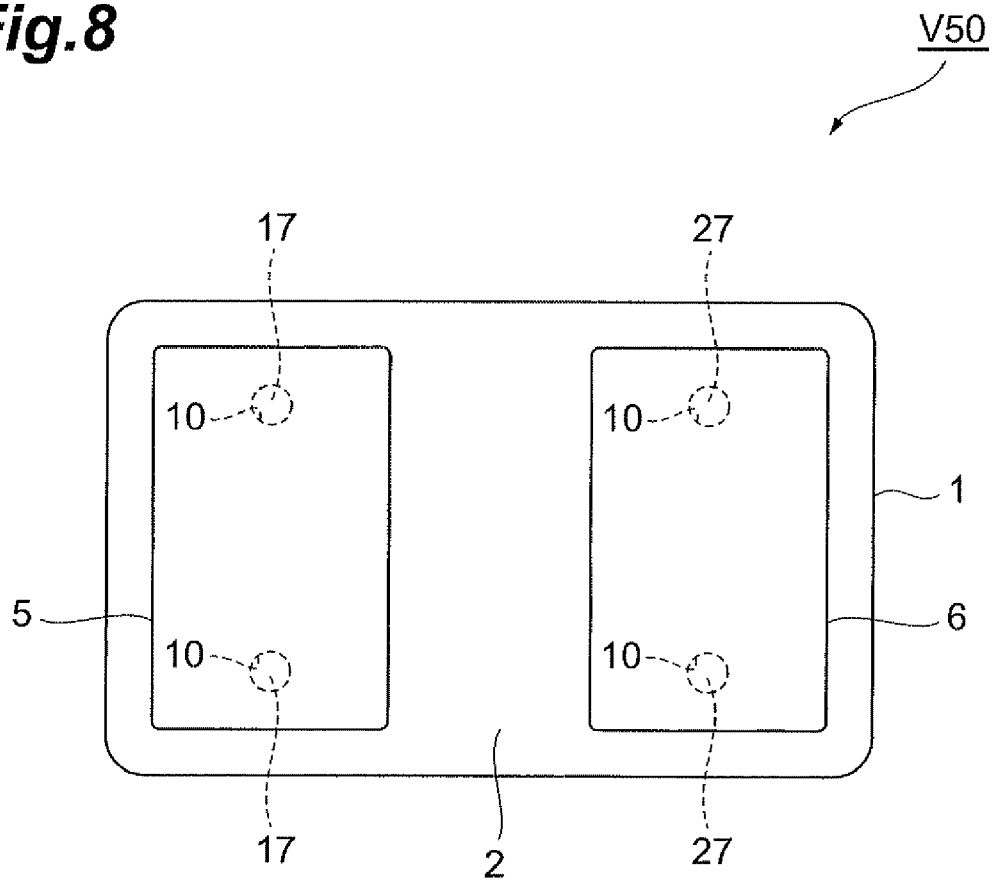
FIG. 8 is a bottom view showing a multilayer chip varistor according to a modification example, which is a drawing corresponding to FIG. 2.
Figure 9:
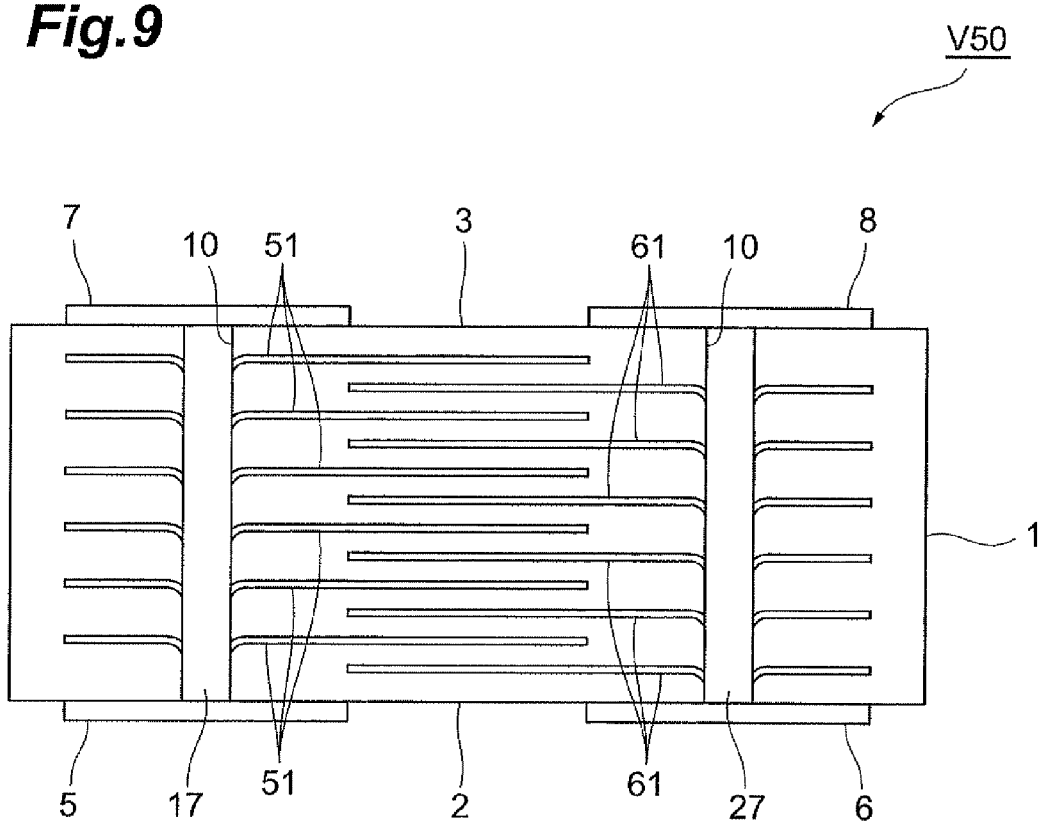
FIG. 9 is a sectional view of the multilayer chip varistor according to the modification example, which is a drawing corresponding to FIG. 3.
Figure 10:
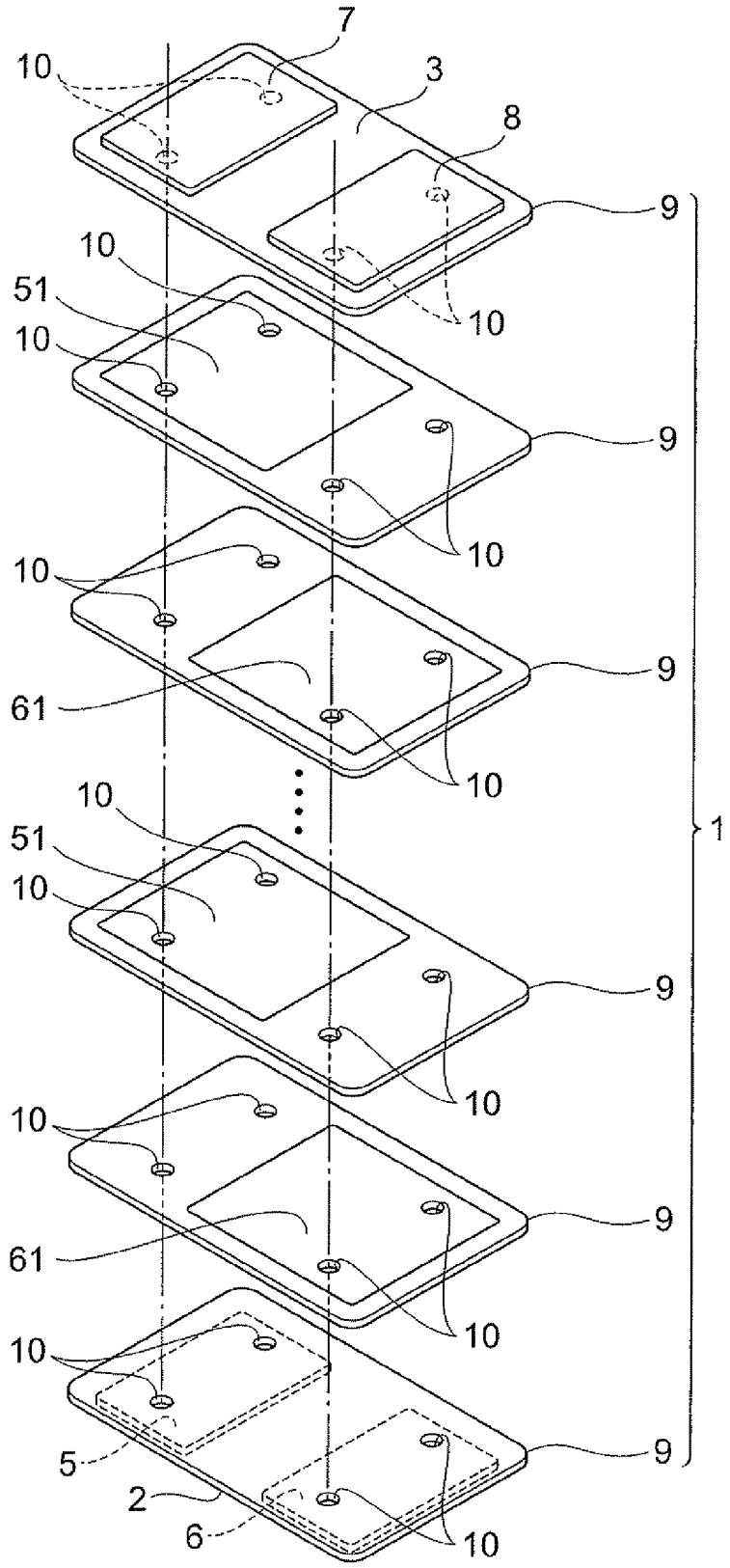
FIG. 10 is a development view showing the chip varistor according to the modification example, which is a drawing corresponding to FIG. 4.

The present embodiment showed the configuration wherein the internal electrode 11 had the electrode portions 13, 15 and wherein the internal electrode 21 had the electrode portions 23, 25, but there are no particular restrictions on the shape of the internal electrodes; for example, it is possible to adopt internal electrodes of a rectangular shape, as shown in FIGS. 8 to 10.

FIG. 8 is a bottom view showing a multilayer chip varistor V50 of a modification example, which is a drawing corresponding to FIG. 2. FIG. 9 is a sectional view of the multilayer chip varistor V50 of the modification example, which is a drawing corresponding to FIG. 3. FIG. 10 is a development view showing the chip varistor V50 of the modification example, which is a drawing corresponding to FIG. 4. The multilayer chip varistor V50 of the modification example, as shown in FIG. 8, has a pair of through-hole conductors 17 connected to the external electrodes 5, 7 and a pair of through-hole conductors 27 connected to the external electrodes 6, 8.

As shown in FIGS. 9 and 10, the internal electrodes 51 are located on one end side on the respective varistor layers 9 and are of a rectangular shape extending toward the other end while having a width corresponding to the external electrodes 5, 7. The internal electrodes 61 are located on the other end side on the respective varistor layers 9 and are of a rectangular shape extending toward the one end while having a width corresponding to the external electrodes 6, 8. In this configuration, the regions of the varistor layers 9 overlapping with the internal electrodes 51 and the internal electrodes 61 function as regions to exhibit the varistor characteristic.

What is claimed is:

1. A multilayer chip varistor comprising:

a varistor layer to exhibit a nonlinear voltage-current characteristic;

a plurality of internal electrodes arranged as opposed to each other with the varistor layer in between; and a through-hole conductor formed in a through hole penetrating the varistor layer and the plurality of internal electrodes, said through-hole conductor electrically connecting the plurality of internal electrodes, wherein at least one of the plurality of internal electrodes is curved toward a direction of penetration of the through hole in a connection portion thereof to the through-hole conductor.

2. The multilayer chip varistor according to claim 1, wherein in the internal electrode curved in the connection portion, a thickness in a contact portion with the through-hole conductor is larger than a thickness in a portion other than the connection portion.

3. A multilayer chip varistor comprising:

a varistor layer to exhibit a nonlinear voltage-current characteristic;

a plurality of internal electrodes arranged as opposed to each other with the varistor layer in between; and a through-hole conductor formed in a through hole penetrating the varistor layer and the plurality of internal electrodes, said through-hole conductor electrically connecting the plurality of internal electrodes, wherein at least one of the plurality of internal electrodes is so configured in a connection portion thereof to the through-hole conductor that the varistor layer is sandwiched between the internal electrode and the through-hole conductor in a direction perpendicular to a direction of penetration of the through hole, and at least one of the internal electrodes is depressed in the direction of penetration of the through hole so as to be tapered in the connection portion, whereby the varistor layer is sandwiched between the internal electrode and the through-hole conductor in the direction perpendicular to the direction of penetration of the through hole.

* * * * *